US010812907B2

(12) United States Patent
Liniado et al.

(10) Patent No.: US 10,812,907 B2
(45) Date of Patent: Oct. 20, 2020

(54) EXPANDABLE SPEAKER SYSTEM AND METHOD FOR BROADCAST

(71) Applicant: DGL Grou USA, Edison, NJ (US)

(72) Inventors: Marc Liniado, Brooklyn, NY (US); Andrew Kohlsmith, Ontario (CA)

(73) Assignee: DGL Group Ltd., Edison, NJ (US)

( * ) Notice: Subject to any disclaimer, the term of this patent is extended or adjusted under 35 U.S.C. 154(b) by 0 days.

(21) Appl. No.: 16/243,222

(22) Filed: Jan. 9, 2019

(65) Prior Publication Data

US 2019/0222934 A1 Jul. 18, 2019

Related U.S. Application Data

(60) Provisional application No. 62/615,038, filed on Jan. 9, 2018.

(51) Int. Cl.

| | |
|---|---|
| ***H04R 1/02*** | (2006.01) |
| ***H04R 5/02*** | (2006.01) |
| ***H04R 5/04*** | (2006.01) |

(52) U.S. Cl.

CPC ..... *H04R 5/02* (2013.01); *H04R 1/025* (2013.01); *H04R 5/04* (2013.01); *H04R 2420/07* (2013.01); *H04R 2430/01* (2013.01)

(58) Field of Classification Search

CPC . H04R 5/02; H04R 1/025; H04R 5/04; H04R 2420/07; H04R 2430/01

See application file for complete search history.

(56) References Cited

U.S. PATENT DOCUMENTS 8,483,757 B2 7/2013 Bodley et al.
8,509,463 B2 * 8/2013 Goh ..... H04R 5/04 381/17

(Continued)

FOREIGN PATENT DOCUMENTS

KR 10-1641510 7/2016

OTHER PUBLICATIONS

Hub | The first Hi-Fi, Wi-Fi hub for headphones and speakers by ekko audio, LLC.—Kickstarter; https://www.kickstarter.com/projects/ekkowifi/hub-by-ekko-the-first-hi-fi-wi-fi-hub-for-headphon; Nov. 15, 2018.

(Continued)

*Primary Examiner* — David L Ton
(74) *Attorney, Agent, or Firm* — Myers Wolin, LLC

(57) ABSTRACT

An expandable wireless speaker system and method is disclosed. The speaker system comprises a center module and at least two or more speakers. The center module has a unique identification number and has mechanical connections on at least one side. The center module is configured to receive an external device, wirelessly or directly connected and has a transceiver configured to scan for an unused channel and transmit audio. The speakers each have a mechanical connection on either side to connect to the center module or the other speakers. The two or more speakers are configured to scan the communication spectrum for the center module's unique identification and when the two or more speakers locate the center module's unique identification, the two or more speakers pair with the center module to receive audio. The communication spectrum can be a wireless channel such as 5.8 GHz or the FM radio spectrum.

17 Claims, 7 Drawing Sheets

(56) References Cited

U.S. PATENT DOCUMENTS

| | | | | |
|---|---|---|---|---|
| 8,638,957 | B2 | 1/2014 | Sim et al. | |
| 9,294,840 | B1 * | 3/2016 | Anderson | H04R 5/00 |
| 9,883,265 | B2 | 1/2018 | Cheney et al. | |
| 10,111,003 | B2 | 10/2018 | Ang et al. | |
| 2007/0263888 | A1 * | 11/2007 | Melanson | H04S 3/00 381/300 |
| 2011/0286613 | A1 | 11/2011 | Lipsky et al. | |
| 2015/0049895 | A1 | 2/2015 | Walter et al. | |
| 2015/0287419 | A1 | 10/2015 | Chen et al. | |
| 2016/0150320 | A1 | 5/2016 | Hetke et al. | |

OTHER PUBLICATIONS

International Search Report (including Translated Abstract of KR10-1641510); corresponding PCT Application Serial No. PCT/US2019/012816, International Filing Date Jan. 9, 2019; Authorized Officer Min Jeong Kang; dated Apr. 30, 2019.

Written Opinion; corresponding PCT Application Serial No. PCT/US2019/012816, International Filing Date Jan. 9, 2019; Authorized Officer Min Jeong Kang; dated Apr. 30, 2019.

* cited by examiner

EXPANDABLE SPEAKER SYSTEM AND METHOD FOR BROADCAST

CROSS-REFERENCE TO RELATED APPLICATION

The present application claims the benefit of U.S. Provisional Patent Application No. 62/615,038 filed on Jan. 9, 2018. The entire contents of this disclosure is hereby expressly incorporated by reference in its entirety.

FIELD OF INVENTION

The present disclosure is directed to an expandable wireless speaker system. More particularly, the present disclosure is directed to a speaker system and method of wirelessly communicating with at least one or more remote speakers to broadcast audio information from a connected device.

BACKGROUND

Audio systems include an audio source, such as a receiver, phone, computer, television, or other A/V device in communication with one or more speakers. The audio source may be communication with the speakers through a wired connection or by wireless communication means. Current systems and methods for wirelessly broadcasting and playing audio utilize Bluetooth or other wireless communication protocols. However, such wireless communication protocols do not allow for real-time audio listening and introduce a delay to be used with video to allow the sound to catch up. Additionally, current wireless systems may transmit audio from a device to a single receiver. This does not allow for surround sound or expandable systems.

SUMMARY OF THE INVENTION

In one embodiment, an expandable speaker system is described. The speaker system comprises a center module with a unique identification number, wherein the center module is configured to communicate with an external audio device, wherein the center module has a first connector on a first side and a second connector on a second side, and at least two speakers in signal communication with the center module, the at least two speakers including a first speaker and a second speaker, wherein each of the at least two speakers has a volume control, wherein the first speaker includes a third connector configured to mechanically connect to the first connector, wherein the second speaker includes a fourth connector configured to mechanically connect to the second connector, wherein when the third connector is mechanically connected to the first connector and the fourth connector is mechanically connected to the second connector, the center module transmits a left stereo sound component to the first speaker and a right stereo sound component to the second speaker.

In another embodiment, a method for broadcasting audio through a speaker system, is described. The method comprises receiving signal communication from an external audio device at a center module and transmitting audio from the center module to at least two speakers, wherein when the at least two speakers are connected to the center module via a mechanical connection, each of the at least two or more speakers transmits a portion of audio dependent upon the location of the at least two or more speakers to the center module.

In yet another embodiment a speaker module is described. The speaker module comprises a power button, volume controls, a first connector, a second connector, a transceiver configured to scan a communication band for a device identification, and pairing the speaker module with the device to receive audio and an output module for broadcasting audio from the device.

BRIEF DESCRIPTION OF THE DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

The disclosure is described in the context of utilizing FM radio transmissions and wireless communication bands with one way communication.

Figure 1:
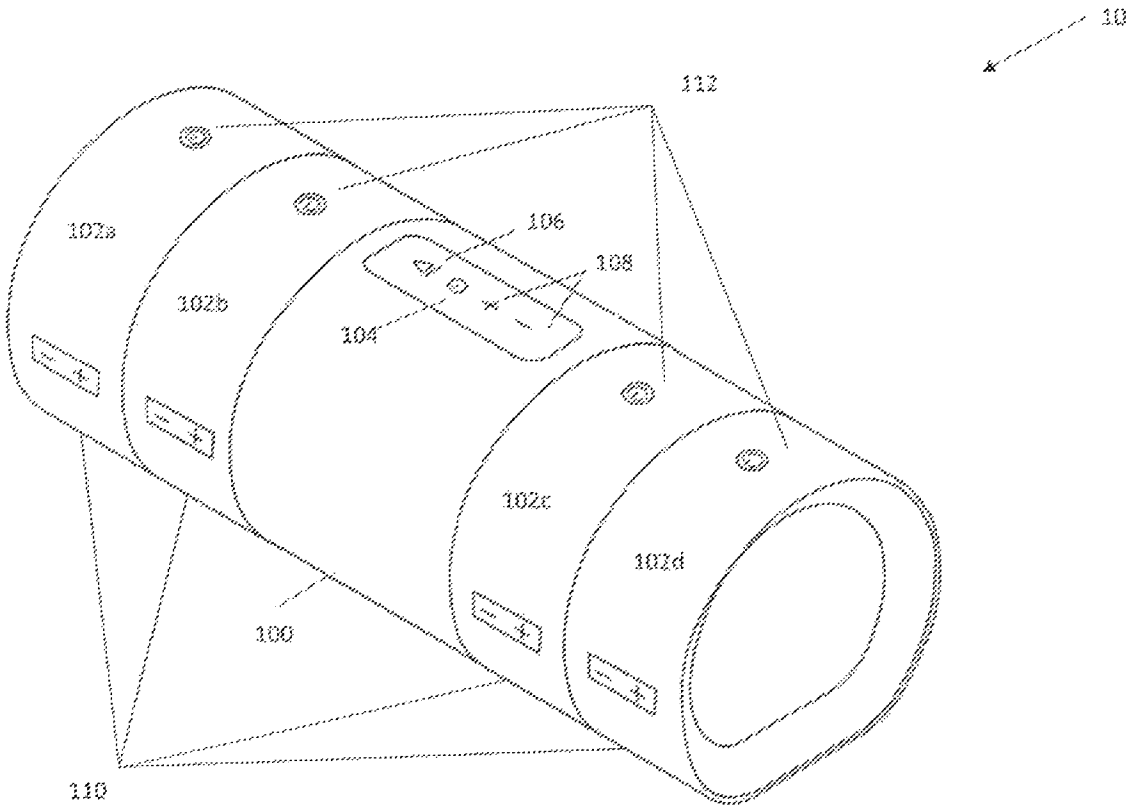
FIG. 1 illustrates one embodiment of a speaker system with a center module and speakers attached.

FIG. 1 illustrates a perspective view of one embodiment of a speaker system 10. The system 10 includes two main elements, a center module 100 and four expandable speakers 102*a*, 102*b*, 102*c*, 102*d*.

The center module 100 and speakers 102*a*, 102*b*, 102*c*, 102*d* are attached for transportation purposes. In one embodiment, the speakers 102*a*, 102*b*, 102*c*, 102*d* and center module 100 are attached using a magnetic connection. In another embodiment, the speakers 102*a*, 102*b*, 102*c*, 102*d* and center module 100 are attached using a snap mechanism. In yet another embodiment, the speakers 102*a*, 102*b*, 102*c*, 102*d* and center module 100 are attached by sliding the speakers 102*a*, 102*b*, 102*c*, 102*d* and/or center module 100 utilizing an interlocking connection.

As the system 10 is intended to be expandable and remote, the center module 100 has its own power control button 104, audio control button 106, and volume control buttons 108, and the speakers 102*a*, 102*b*, 102*c*, 102*d* each have their own power button 112 and volume controls 110 allowing each unit to have individual control of sound levels and power. In another embodiment, less than four speakers can be utilized in the system or additional speakers can be added to the ends of the existing speaker system 10. In yet another embodiment, the center module 100 and speakers 102*a*, 102*b*, 102*c*, 102*d* are waterproof.

Figure 2:
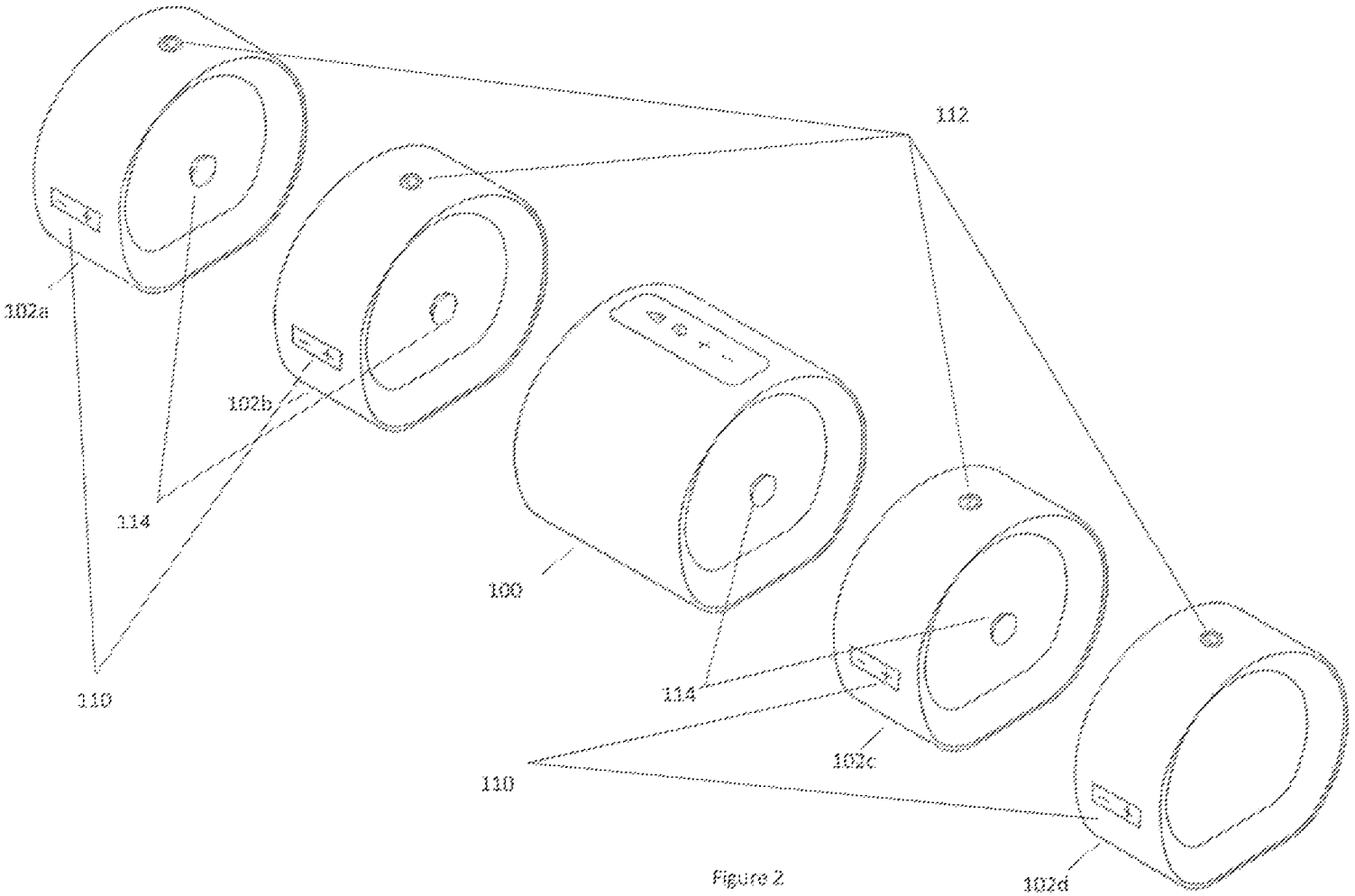
FIG. 2 illustrates the speaker system with the center module and the speakers detached.
Figure 3:
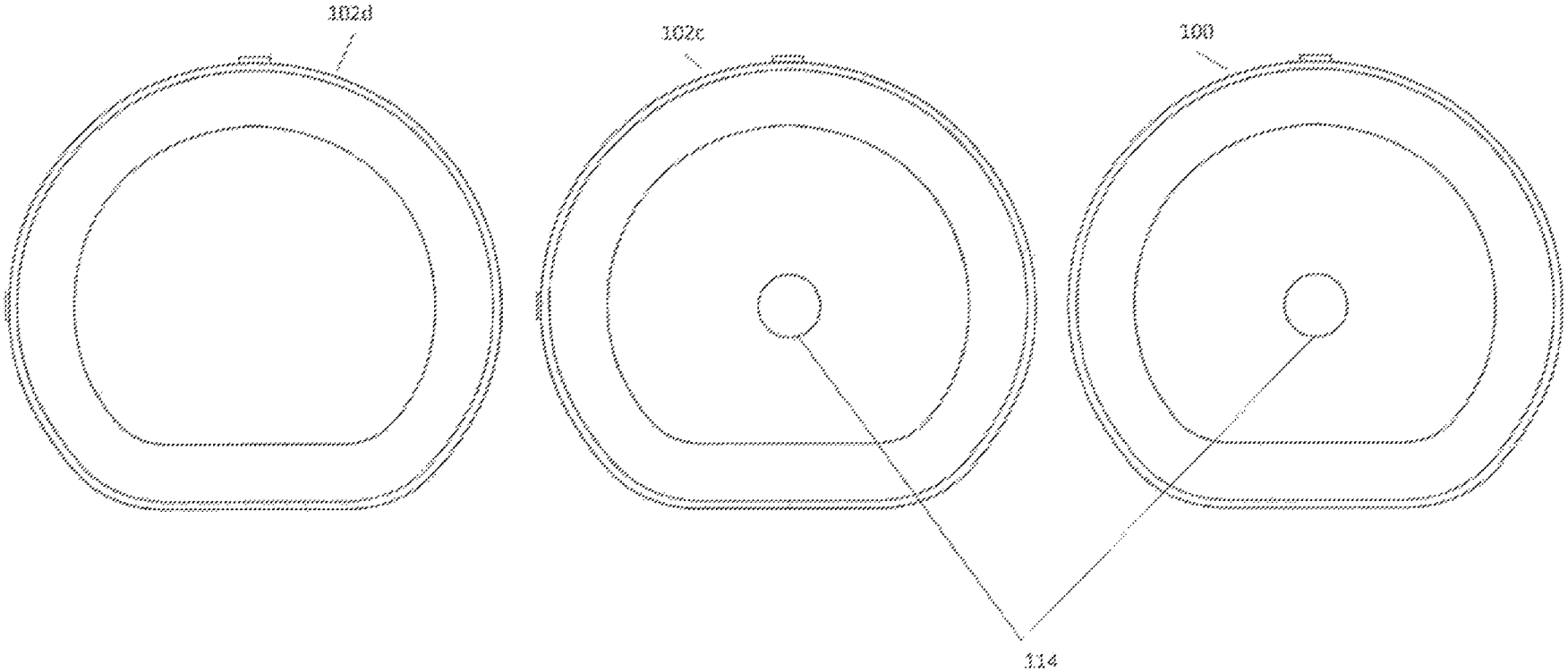
FIG. 3 illustrates a side view of the connections of the speakers.

Turning to FIGS. 2 and 3, when the system 10 is in use, each of the speakers 102*a*, 102*b*, 102*c*, 102*d* can be disconnected from the center unit. As can be seen in this exploded view, the center module 100 and the speakers 102*a*, 102*b*, 102*c* each include a connection 114. In this embodiment, the end speaker 102*d* does not include a connection. In alternative embodiments, each speaker includes a connection.

Where the connection is a snap connection or a magnetic connection, the speakers 102 are disconnected by applying sufficient force to overcome the magnetic or friction force of the connection. Where the connection is a sliding connection, the speakers 102 are disconnected by sliding or turning the speakers. The speakers may also be connected by a locking mechanism with a release mechanism (not shown in this view). After separation, the speakers 102*a*, 102*b*, 102*c*, 102*d* can be placed within 200 feet of the center module 100, such as around a room, in preparation for use. When the system 10 is done being utilized, each speaker 102*a*, 102*b*, 102*c*, 102*d* may be reconnected to the center module 100 using the same connection 114 in preparation for storage or travel.

Each of the speakers 102*a*, 102*b*, 102*c*, 102*d* is capable of producing whole or partial sound, depending upon how the speaker 102*a*, 102*b*, 102*c*, 102*d* is utilized. When in use, if the speakers 102*a*, 102*b*, 102*c*, 102*d* are detached from the center module 100, each speaker 102*a*, 102*b*, 102*c*, 102*d* produces whole audio. In another embodiment, when the speakers 102*a*, 102*b*, 102*c*, 102*d* are connected to the center module 100 and are in use, each speaker only produces a portion of audio. For example, a speaker 102*a*, 102*b*, 102*c*, 102*d* that is connected to the left of the center module 100 produces left stereo sound, while a speaker 102*a*, 102*b*, 102*c*, 102*d* that is connected to the right of the center module 100 will produce right stereo sound.

The connection 114 also serves to transfer power between the center module 100 and the speakers 102*a*, 102*b*, 102*c*, 102*d*. Each speaker includes an individual battery (not shown). To charge the batteries of the speakers in the system 10, the center module 100 is plugged into a power source. While the center module 100 charges, power is also transferred to the attached speakers 102*a*, 102*b*, 102*c*, 102*d* through the connection 114 thus eliminating the need to charge the speakers 102*a*, 102*b*, 102*c*, 102*d* individually.

Figure 4:
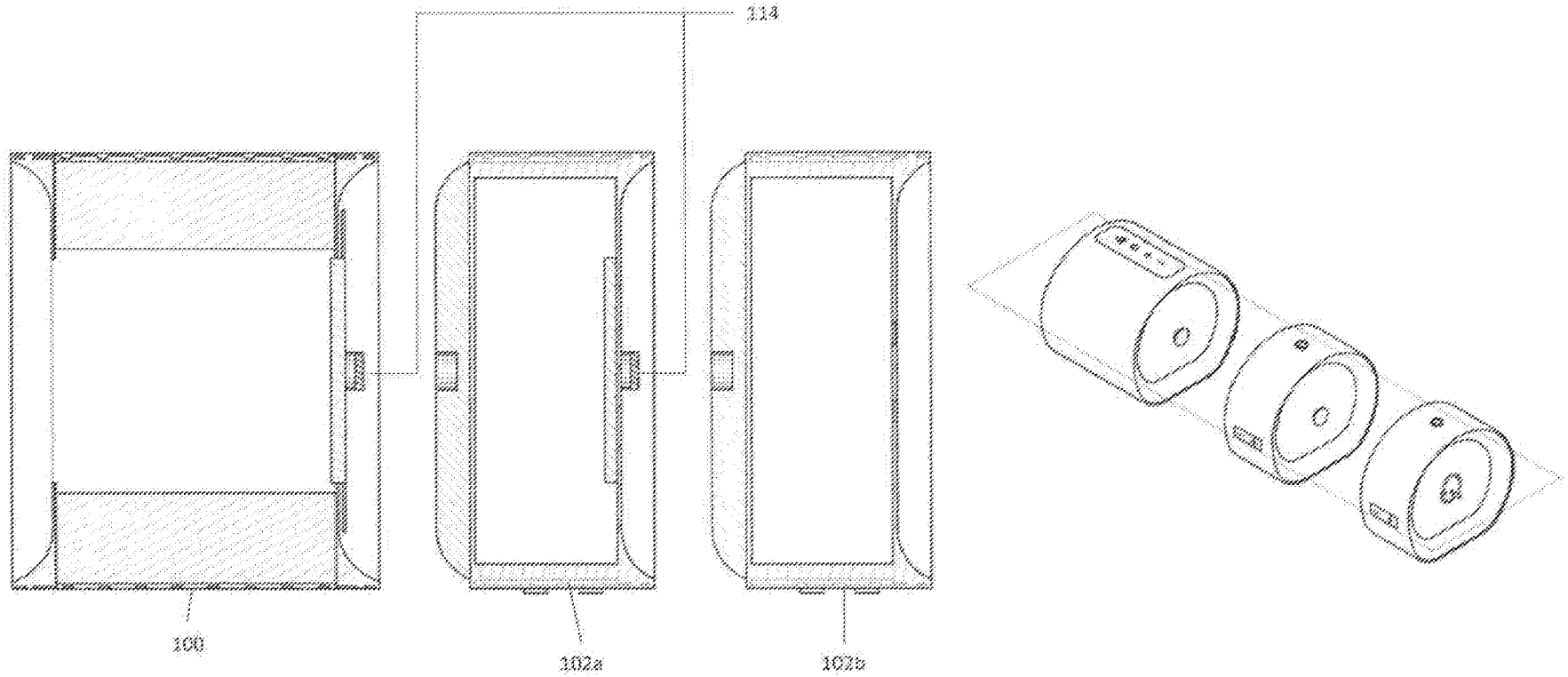
FIG. 4 illustrates a cross-sectional view of the connections of the speaker system

As illustrated in the cross-sectional view of the system 10 in FIG. 4, the connections 114 both mechanically and electrically connect the speakers 102*a*, 102*b*, 102*c*, 102*d* to each other and to the center module 100. The electrical connection allows for the transfer of power from the center module 100.

In the illustrated embodiment, the center module 100 includes a male connector on the right side. A middle speaker 102*a* has a female connector on its left side, configured to receive the male connector of the center module 100. The middle speaker 102*a* also includes a male connector on its right side. An end speaker 102*b* includes a female connector on its left side, configured to receive the male connector of the middle speaker 102*a*. In the illustrated embodiment, the end speaker only includes a single connector. In an alternative embodiment, the end speaker may include an additional connector on a right side to allow connection to additional speakers.

While the illustrated embodiment does not show a connector on the left side of the center module 100, it should be understood that in alternative embodiments, any type of connector may be employed on each side of the center module and speakers.

Figure 5:
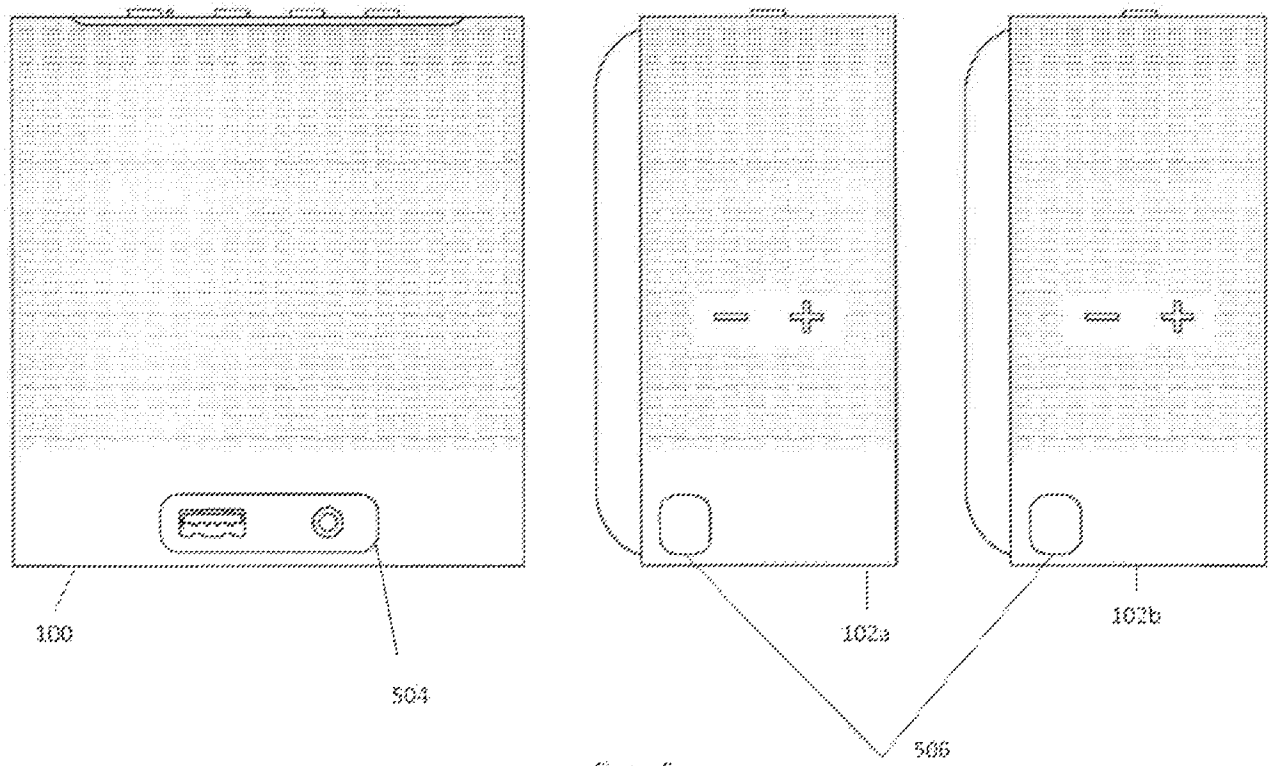
FIG. 5 illustrates a rear view of a portion of the speaker system with the center module and the speakers detached.

FIG. 5 illustrates a rear view of a portion of the speaker system 10. In this view, a release button 506 is shown on the back of the speakers 102*a*, 102*b*. The center module 100 is configured to be in signal communication with an external audio device. Exemplary audio devices include, without limitation, radio receivers, phones, tablets, computers, phonographs, televisions, MP3 players, compact disk players, and cassette players. In one embodiment, an external device plugs into the center module 100 using a line in or other input 504. In another embodiment, the center module 100 wirelessly communicates with the external audio device through a communication protocol such as Bluetooth. When an external device is connected to the center module 100, the center module 100 communicates with the speakers 102*a*, 102*b*, 102*c*, 102*d* using RF communication. In one embodiment, the center module 100 communicates with the speakers 102*a*, 102*b*, 102*c*, 102*d* using FM radio waves resulting in very little delay or no delay. In another embodiment, the center module 100 communicates with the speakers 102*a*, 102*b*, 102*c*, 102*d* using a wireless connection band.

Figure 6:
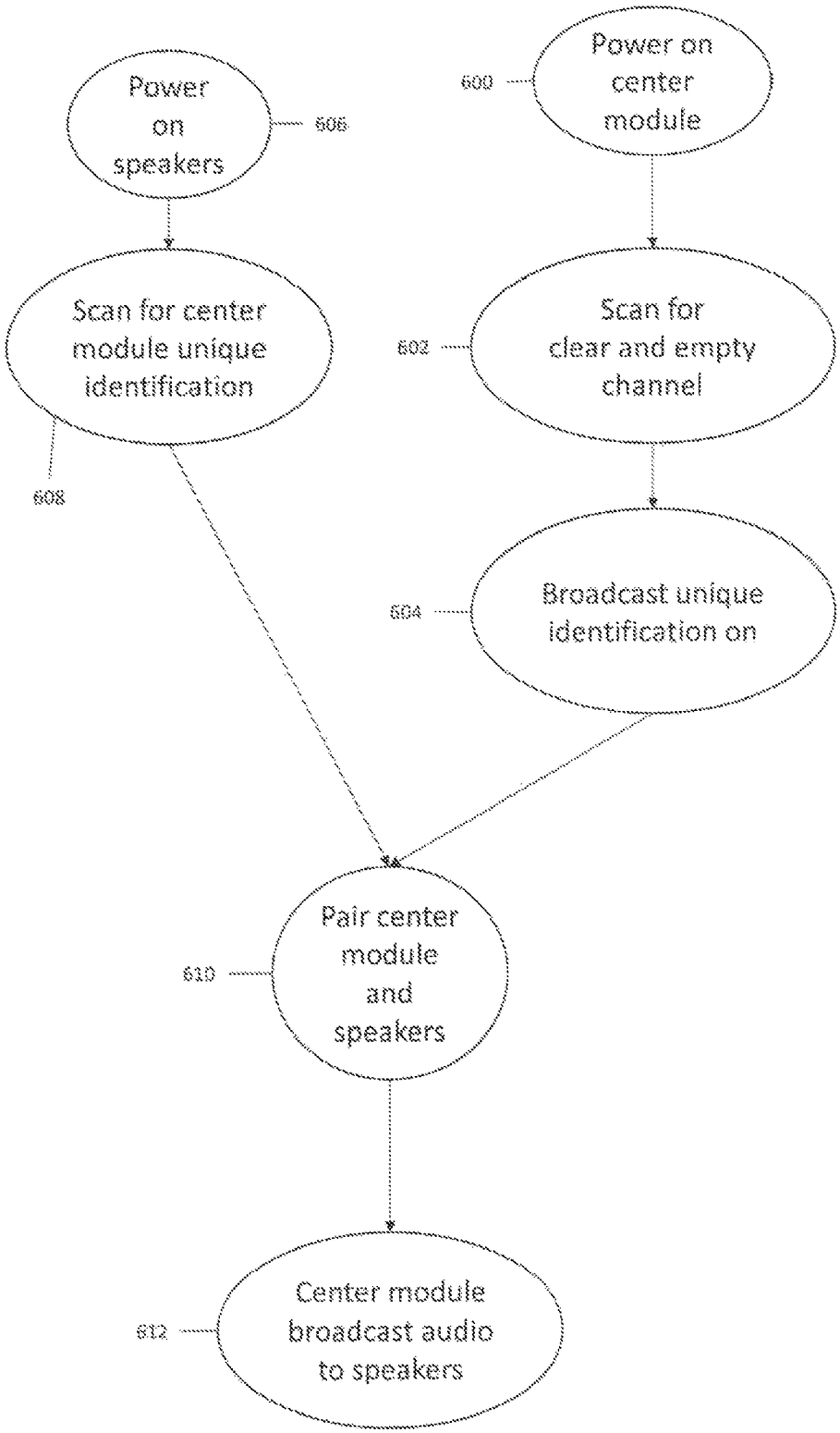
FIG. 6 illustrates a flowchart for audio communication utilizing the proposed system.

As illustrated by the flowchart of FIG. 6, initializing the speaker system 10 occurs using the existing wireless band or FM radio spectrum. In one embodiment, the system 10 functions utilizing one-way communication from the center module 100 to the speakers 102*a*, 102*b*, 102*c*, 102*d*, eliminating the need for establishing a handshake or additional connections between the center module 100 and the speakers 102*a*, 102*b*, 102*c*, 102*d*. The center module 100 contains with a unique identification number. When the center unit is powered on 600, the center module 100 initializes the wireless band and broadcasts its unique identification using the wireless band. In one embodiment, the wireless band is a 5.8 GHz wireless band. In an alternative embodiment, the system 10 functions utilizing two-way communication from the center module 100 to the speakers 102*a*, 102*b*, 102*c*, 102*d*, which may include a handshake or other pairing step. In such an embodiment, the two-way communication may occur over a 5.8 GHz wireless band.

In one embodiment, when the center unit is powered on 600, the center module 100 scans the FM radio spectrum for a clear and unused channel 602. When an empty channel is found, the center module 100 broadcasts its unique identification on that channel using the Radio Data System (RDS) communications protocol 604. If this is the first broadcast for the center module 100, the center module 100 begins searching for a clear and empty channel starting with the lowest known FM radio channel. If this is not the first broadcast for the center module 100, the center module 100 starts the scan of the FM radio spectrum at the last known channel it broadcasted on to determine if it is a clear and empty channel. If it is, the center module 100 will broadcast its unique identification. If the last known channel is no longer clear and empty, the center module 100 will begin searching the FM radio spectrum.

The speakers 102*a*, 102*b*, 102*c*, 102*d* are also powered on 606 and begin scanning searching for the center module's 100 unique identification 608 on either the wireless band or the FM radio spectrum. The speakers 102*a*, 102*b*, 102*c*, 102*d* may be powered on before the center module 100 is powered on. Alternatively, the speakers 102*a*, 102*b*, 102*c*, 102*d* may be powered on at the same time or after the center module 100 is powered on. Each speaker may be manually powered on individually, by pressing a power button 112. Alternatively, the speakers 102*a*, 102*b*, 102*c*, 102*d* may be powered on by the center module 100, such as through a wireless signal or through the connection 114.

The speakers 102*a*, 102*b*, 102*c*, 102*d* are programmed to look for only the center module 100 unique identification. In one embodiment, the speakers connect to the wireless band and search for the center module's 100 unique identification. In another embodiment, the speakers begin with the last known channel the center module 100 broadcasted on and searches for the center module's 100 unique identification. If the center module is not located on that channel, the speakers 102*a*, 102*b*, 102*c*, 102*d* begin scanning the FM radio spectrum. If this is the first time the speakers 102*a*, 102*b*, 102*c*, 102*d* have connected to the center module 100, the speakers 102*a*, 102*b*, 102*c*, 102*d* begin scanning for the center module's 100 unique identification starting with the lowest known FM radio channel.

When the center module 100 and the speakers 102*a*, 102*b*, 102*c*, 102*d* are paired 610 the center unit can broadcast audio 612 from the external modules to the speakers 102*a*, 102*b*, 102*c*, 102*d* over the selected communication channel. The entire process connecting the center module 100 to the speakers 102*a*, 102*b*, 102*c*, 102*d* takes only a few seconds or fractions of a second.

In an alternative embodiment, where the center module 100 and the speakers 102*a*, 102*b*, 102*c*, 102*d* are in two-way communication over a 5.8 GHz wireless band, the speakers and module may be paired together with a handshake or other communication protocol, and the step of scanning over a communication band may be omitted.

In one embodiment, additional speakers can be added to the ends of the existing system 10 using the same connection 114. If additional speakers are added to the system 10, the new speakers would need to be paired with the center module 100 to look for the center module's 100 unique identification. However, no handshake or additional connections are necessary. The present system 10 allows for multiple units in the same house without interference because each speaker is coded to only look for the paired center module 100.

In another embodiment, if additional speakers (not shown) are added to the system 10, the new speakers would simply be connected to the existing system 10. Upon connection to the center module 100 or an existing speaker 102*a*, 102*b*, 102*c*, 102*d*, an electrical signal would be passed between the speaker connections to the new speaker providing the new speaker with the center module 100 connection information. The speakers can then be removed as previously described and are ready to begin broadcasting audio.

Figure 7:
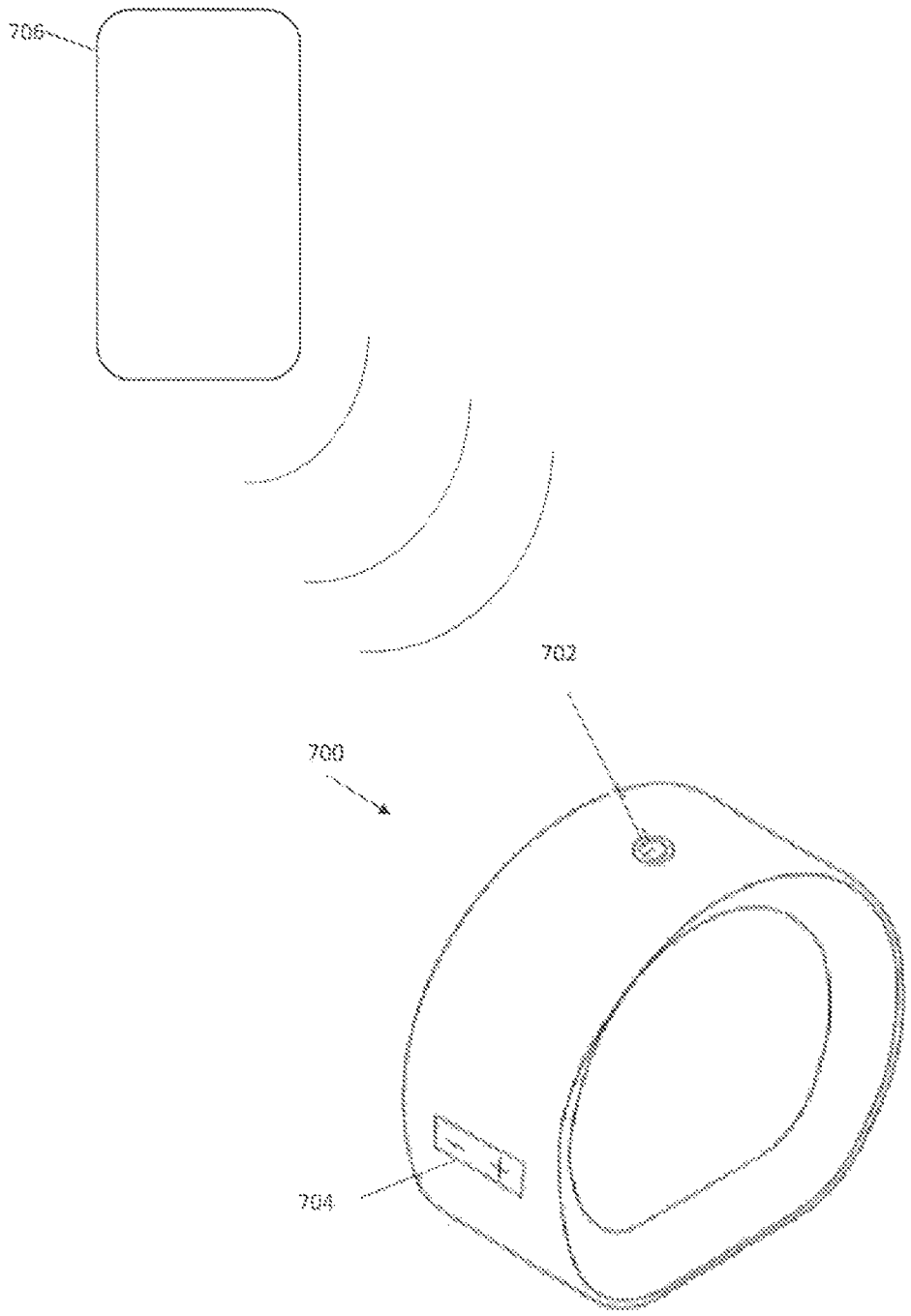
FIG. 7 illustrates a stand-alone speaker.

FIG. 7 illustrates a single stand-alone speaker 700 that can be used without a connection to a center module 100. The single stand-along speaker 700 can be removed from the system 10 and placed within a 200 ft radius around an existing audio module (not shown). The stand-alone speaker 700 still has its own power button 702 and volume controls 704 allowing the unit to have individual control of sound levels and power. When the system 10 is done being utilized, the stand-alone speaker 700 can be reconnected to a larger system with a center module 100 for charging in preparation for storage or travel or simply powered off in preparation for storage or travel.

The stand-alone speaker 700 functions utilizing one-way communication from an external audio device 706. Exemplary audio devices include, without limitation, radio receivers, phones, tablets, computers, phonographs, televisions, MP3 players, compact disk players, and cassette players. In one embodiment, the external device plugs into the stand-alone speaker 700 using a line in or other input. In another embodiment, the stand-alone speaker 700 wirelessly communicates with the external audio device through a communication protocol such as Bluetooth. The stand-alone speaker 700 can be used as a single unit or can be used with multiple stand-alone speakers that each connect to the external audio device. When utilized as a stand-alone speaker 700, without connecting to a center module 100, the stand-alone speaker 700 produces whole audio sound.

In another embodiment, the system 10 can be utilized in a conference call environment. The system 10 would include the center module 100 and the four or more speakers 102*a*, 102*b*, 102*c*, 102*d* spaced around a room for conference calling. The center module 100 and speakers 102*a*, 102*b*, 102*c*, 102*d* would connect in the same manner as previously described, however, the center module 100 and the speakers 102*a*, 102*b*, 102*c*, 102*d* would be set up for two way communication instead of simply one-way communication. Two-way communication allows the conference room attendees to talk during the call without having to move the microphone closer to the speaker. The system 10 would still function without requiring a handshake between the center module 100 and the speakers 102*a*, 102*b*, 102*c*, 102*d*.

The above merely illustrates the principles of the invention. It is thus appreciated that those skilled in the art will be able to devise various arrangements, which, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. An expandable speaker system, comprising:

a center module with a unique identification number, wherein the center module is configured to communicate with an external audio device, wherein the center module has a first connector on a first side and a second connector on a second side; and at least two speakers in signal communication with the center module, the at least two speakers including a first speaker and a second speaker, wherein each of the at least two speakers has a volume control, wherein the first speaker includes a third connector configured to mechanically connect to the first connector, wherein the second speaker includes a fourth connector configured to mechanically connect to the second connector, wherein when the third connector is mechanically connected to the first connector and the fourth connector is mechanically connected to the second connector, the center module transmits a left stereo sound component to the first speaker and a right stereo sound component to the second speaker, wherein when the third connector is disconnected from the first connector and the fourth connector is disconnected from the second connector, the center module transmits an audio signal including the left stereo sound component and the right stereo sound component to the first speaker and the audio signal including the left stereo sound component and the right stereo sound component to the second speaker.

2. The expandable speaker system of claim 1, wherein the third connector is connected to the first connector by one of a magnetic connection, a snap-together connection, and a sliding interlock connection, and wherein the fourth connector is connected to the second connector by one of a magnetic connection, a snap-together connection, and a sliding interlock connection.

3. The expandable speaker system of claim 1, wherein the center module is configured to communicate with the external device through one of a line in connection and a wireless connection.

4. The expandable speaker system of claim 1, wherein the at least two speakers are configured to scan a communication band for the center module's unique identification, and wherein the at least two speakers are further configured to save the center module's unique identification and pair with the center module to receive audio.

5. The expandable speaker system of claim 1, wherein the center module and the at least two speakers are in two-way communication over a wireless band.

6. The expandable speaker system of claim 5, wherein the wireless band is a 5.8 GHz wireless channel.

7. The expandable speaker system of claim 1, wherein the center module transceiver further comprises an FM transmitter configured to scan the FM radio spectrum for an unused FM radio channel and transmit audio.

8. The expandable speaker system of claim 6, wherein a radio data system (RDS) of the unused FM radio channel broadcasts the unique identification number of the center module to be received by the two or more speakers.

9. A method for broadcasting audio through a speaker system, comprising:

receiving signal communication from an external audio device at a center module; and transmitting audio from the center module to at least two speakers, wherein when the at least two speakers are connected to the center module via a mechanical connection, each of the at least two or more speakers transmits a portion of audio dependent upon the location of the at least two or more speakers to the center module, and wherein when the at least two speakers are disconnected from the center module, each of the at least two speakers produce audio including a left stereo sound component and a right stereo sound component.

10. The method for broadcasting audio through a speaker system of claim 9, wherein the first connector and second connector are one of a magnetic connection or a snap-together connection or a sliding interlock connection.

11. The method for broadcasting audio through a speaker system of claim 9, further including:

scanning for a clear and unused channel using a transceiver of the center module;

transmitting a unique identifier of the center module on the clear and unused channel;

scanning for the unique identifier of the center module using a receiver of the at least two or more speakers, wherein when the unique identifier is located, saving the center module's unique identifier to the at least two or more speakers and pairing the center module and the least two or more speakers.

12. The method for broadcasting audio through a speaker system of claim 11, wherein the transceiver of the center module further comprises an FM transmitter configured to scan the FM radio spectrum for an unused FM radio channel and transmit audio.

13. The method for broadcasting audio through a speaker system of claim 12, wherein a radio data system (RDS) of the unused FM radio channel broadcasts the unique identification number of the center module to be received by the two or more speakers.

14. The method for broadcasting audio through a speaker system of claim 9, further comprising pairing the center module and the at least two speakers over a wireless band.

15. The method for broadcasting audio through a speaker system of claim 14, wherein the wireless band is a 5.8 GHz wireless band.

16. An expandable speaker system, comprising:

a center module with a unique identification number, wherein the center module is configured to communicate with an external audio device, wherein the center module has a first connector on a first side and a second connector on a second side; and at least two speakers in signal communication with the center module, the at least two speakers including a first speaker and a second speaker, wherein each of the at least two speakers has a volume control, wherein the first speaker includes a third connector configured to mechanically connect to the first connector, wherein the second speaker includes a fourth connector configured to mechanically connect to the second connector, wherein when the third connector is mechanically connected to the first connector and the fourth connector is mechanically connected to the second connector, the center module transmits a left stereo sound component to the first speaker and a right stereo sound component to the second speaker, wherein the center module transceiver further comprises an FM transmitter configured to scan the FM radio spectrum for an unused FM radio channel and transmit audio.

17. The expandable speaker system of claim 16, wherein a radio data system (RDS) of the unused FM radio channel broadcasts the unique identification number of the center module to be received by the two or more speakers.

* * * * *